US006250878B1

(12) United States Patent
Wesling et al.

(10) Patent No.: US 6,250,878 B1
(45) Date of Patent: Jun. 26, 2001

(54) METHOD AND ASSEMBLY FOR CONNECTING AIR DUCTS IN GAS TURBINE ENGINES

(75) Inventors: Richard A. Wesling, Cincinnati; Roger E. Maloon, Fayetteville; Charles J. Geiger, West Chester, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/405,530

(22) Filed: Sep. 24, 1999

(51) Int. Cl.[7] ..... F01D 5/14
(52) U.S. Cl. ..... 415/115; 415/216.1
(58) Field of Search ..... 415/115, 116, 415/134, 136, 138, 216.1, 230; 416/244 A, 244 R; 285/187, 330, 413, 382; 403/364, 345

(56) References Cited

U.S. PATENT DOCUMENTS 5,537,814 * 7/1996 Nastuk et al. ..... 60/39.31
5,961,245 * 10/1999 Garin et al. ..... 403/322.1
6,053,697 * 4/2000 Piekarski et al. ..... 415/115

OTHER PUBLICATIONS

Patent application Serial No. 09/105,478 (Attorney Docket No. 13DV–12610), filed Jun. 26, 1998.

* cited by examiner

*Primary Examiner*—Edward K. Look
*Assistant Examiner*—James M McAleenan
(74) *Attorney, Agent, or Firm*—Andrew C. Hess; Nathan D. Herkamp

(57) ABSTRACT

A coupling assembly for connecting the aft end of an air duct to the compressor rear shaft in a gas turbine engine includes a retaining ring disposed in the central bore of the compressor rear shaft. The retaining ring has a first set of tabs extending axially therefrom, and the air duct has a second set of tabs extending axially from its aft end. The aft end of the air duct is disposed in the bore and positioned relative to the retaining ring so that the first set of tabs intermeshes with the second set of tabs.

25 Claims, 4 Drawing Sheets

METHOD AND ASSEMBLY FOR CONNECTING AIR DUCTS IN GAS TURBINE ENGINES

BACKGROUND OF THE INVENTION

This invention relates generally to gas turbine engines and more particularly to threadless air duct connections for such engines.

A turbofan gas turbine engine used for powering an aircraft in flight typically includes, in serial flow communication, a fan, a low pressure compressor or booster, a high pressure compressor, a combustor, a high pressure turbine, and a low pressure turbine. The combustor generates combustion gases that are channeled in succession to the high pressure turbine where they are expanded to drive the high pressure turbine, and then to the low pressure turbine where they are further expanded to drive the low pressure turbine. The high pressure turbine is drivingly connected to the high pressure compressor via a first rotor shaft, and the low pressure turbine is drivingly connected to both the fan and the booster via a second rotor shaft.

The first rotor shaft is typically made up of a number of sections including a compressor rear shaft that is coupled to the high pressure turbine rotor and a compressor forward shaft. The compressor rear shaft includes a rear cylindrical portion and a forward conical portion. The forward edge of the conical portion is connected to the last stage disk of the high pressure compressor. A tubular air duct extends between the compressor forward shaft and the compressor rear shaft. The air duct has openings formed therein for admitting air bled from the fan or the booster, which is then ducted downstream through a bore defined by the cylindrical portion of the compressor rear shaft to pressurize an aft sump.

In one conventional arrangement, the air duct is connected to the compressor rear shaft by a threaded connection. The air duct has external threads that are threaded and tightened into mating internal threads formed in the bore of the rear shaft. However, during engine operation, particularly in the take-off portion of a flight, the compressor rear shaft grows radially more rapidly than the air duct due to its loading and thermal environment. The thermal expansion is particularly acute at the threaded joint because of its proximity to the conical portion of the rear shaft, which expands rapidly because of the relatively steep angle of the cone. This differential growth causes the threaded joint to loosen, which can lead to motion in the joint and subsequent damage and cracking of the threads. This threaded joint configuration also concentrates vibratory and bending stresses in the air duct, which can lead to fatigue failures.

Accordingly, there is a need for a threadless air duct coupling that can withstand differential thermal expansion while maintaining support of the air duct.

SUMMARY OF THE INVENTION

The above-mentioned need is met by the present invention which provides a coupling assembly and a method for connecting an air duct to a compressor rear shaft in a gas turbine engine. The coupling assembly includes the compressor rear shaft, which has a central bore formed therein, a retaining ring disposed in the bore, and an air duct having one end disposed in the bore. The retaining ring has a first set of tabs, and the air duct has a second set of tabs. The air duct is disposed relative to the retaining ring so that the first set of tabs intermeshes with the second set of tabs.

The present invention and its advantages over the prior art will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
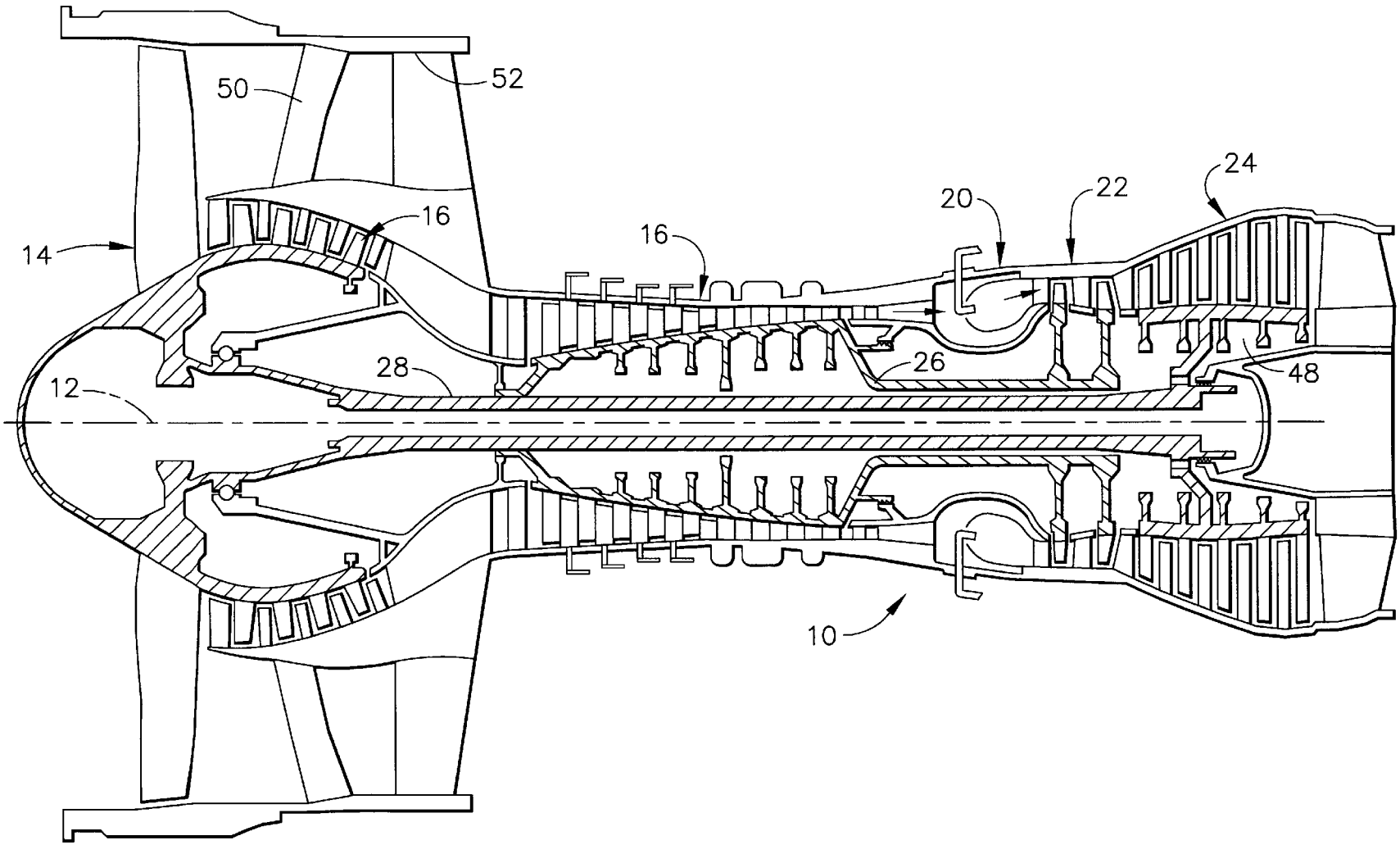
FIG. 1 is partly schematic cross-sectional view of a turbofan engine incorporating the air duct coupling of the present invention.

Referring to the drawings wherein identical reference numerals denote the same elements throughout the various views, FIG. 1 illustrates a longitudinal cross-sectional view of a high bypass ratio turbofan engine 10. The engine 10 includes, in serial axial flow communication about a longitudinal centerline axis 12, a fan 14, a booster 16, a high pressure compressor 18, a combustor 20, a high pressure turbine 22, and a low pressure turbine 24. The high pressure turbine 22 is drivingly connected to the high pressure compressor 18 with a first rotor shaft 26, and the low pressure turbine 24 is drivingly connected to both the booster 16 and the fan 14 with a second rotor shaft 28, which is disposed within the first rotor shaft 26.

Figure 2:
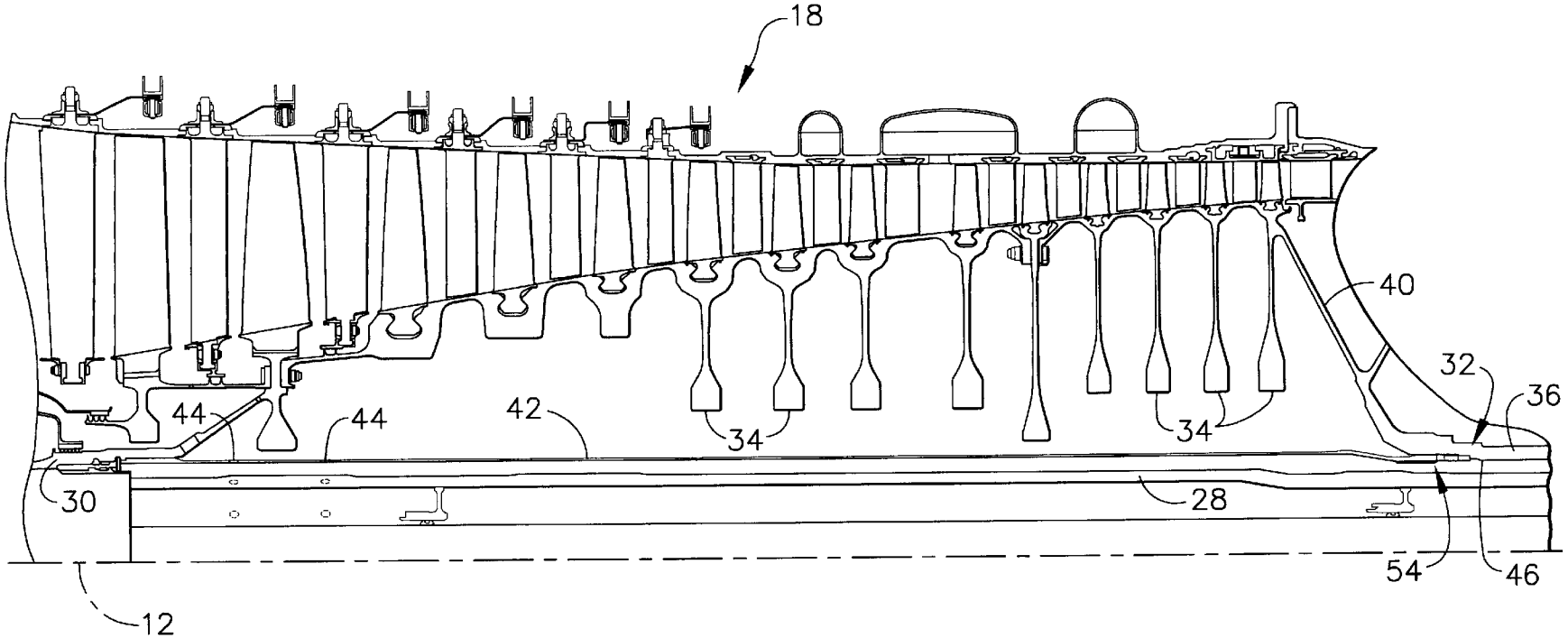
FIG. 2 is a cross-sectional view of the high pressure compressor section of the engine of FIG. 1.

Turning to FIG. 2, it is seen that the first rotor shaft 26 includes a compressor forward shaft 30 and a compressor rear shaft 32. A plurality of high pressure compressor rotor disks 34 are interconnected between the compressor forward shaft 30 and the compressor rear shaft 32 for rotation therewith. The compressor rear shaft 32 includes a cylindrical rear portion 36 and a conical forward portion 40 that is connected to the last stage rotor disk 34. The cylindrical rear portion 36 is coupled to the turbine rotor (which is not shown in FIG. 2, but also forms a section of the first rotor shaft 26) of the high pressure turbine 22. A tubular air duct 42 extends between the compressor forward shaft 30 and the compressor rear shaft 32. The air duct 42 has openings 44 formed therein for admitting air bled from the fan 14 or the booster 16. This air is then ducted downstream through a bore 46 defined by the cylindrical portion 36 of the compressor rear shaft 32 and through a bore in the turbine rotor to pressurize a downstream sump 48 (FIG. 1).

During operation of engine 10, ambient air enters the engine inlet and a first portion of the ambient air, referred to herein as the primary gas stream, passes through the fan 14, the booster 16 and the high pressure compressor 18, being pressurized by each component in succession. As mentioned above, some of this air is bled off from the fan 14 or the booster 16 and is directed through the openings 44 in the air duct 42 for pressurizing the downstream sump 48. The primary gas stream then enters the combustor 20 where the pressurized air is mixed with fuel and burned to provide a high energy stream of hot combustion gases. The high energy gas stream passes through the high pressure turbine 22 where it is expanded, with energy extracted to drive the high pressure compressor 18, and then through the low pressure turbine 24 where it is further expanded, with energy being extracted to drive the fan 14 and the booster 16. A second portion of the ambient air, the bypass airflow, passes through the fan 14 and fan outlet guide vanes 50 (FIG. 1) before exiting the engine 10 through an annular duct 52, whereby the bypass airflow provides a significant portion of the engine thrust.

Figure 3:
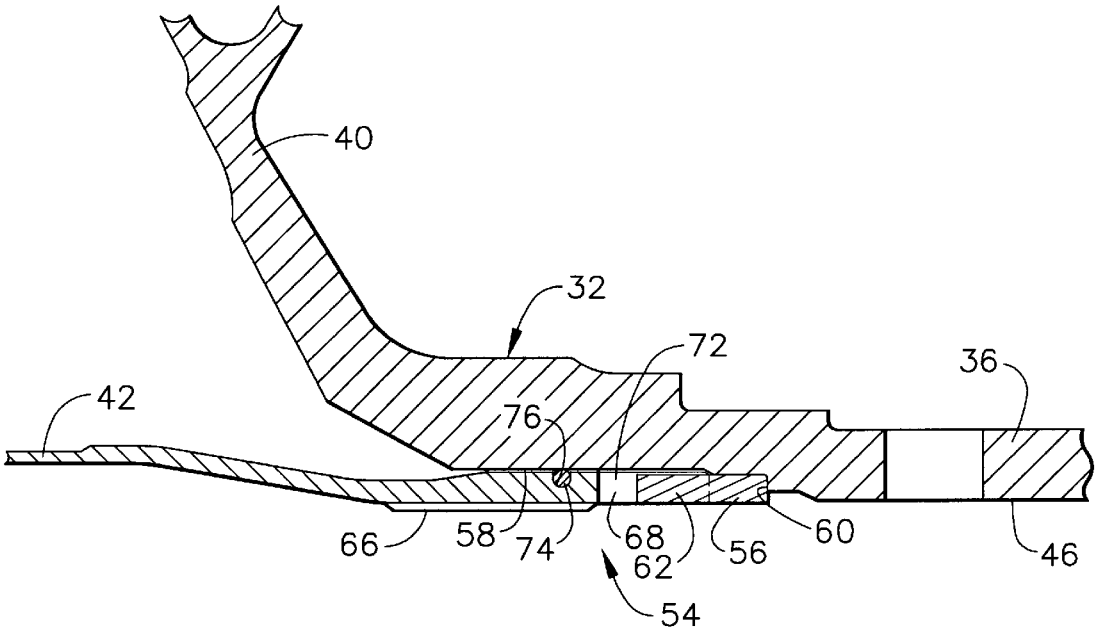
FIG. 3 is a detailed fragmentary cross-sectional view of the air duct coupling of the present invention.
Figure 4:
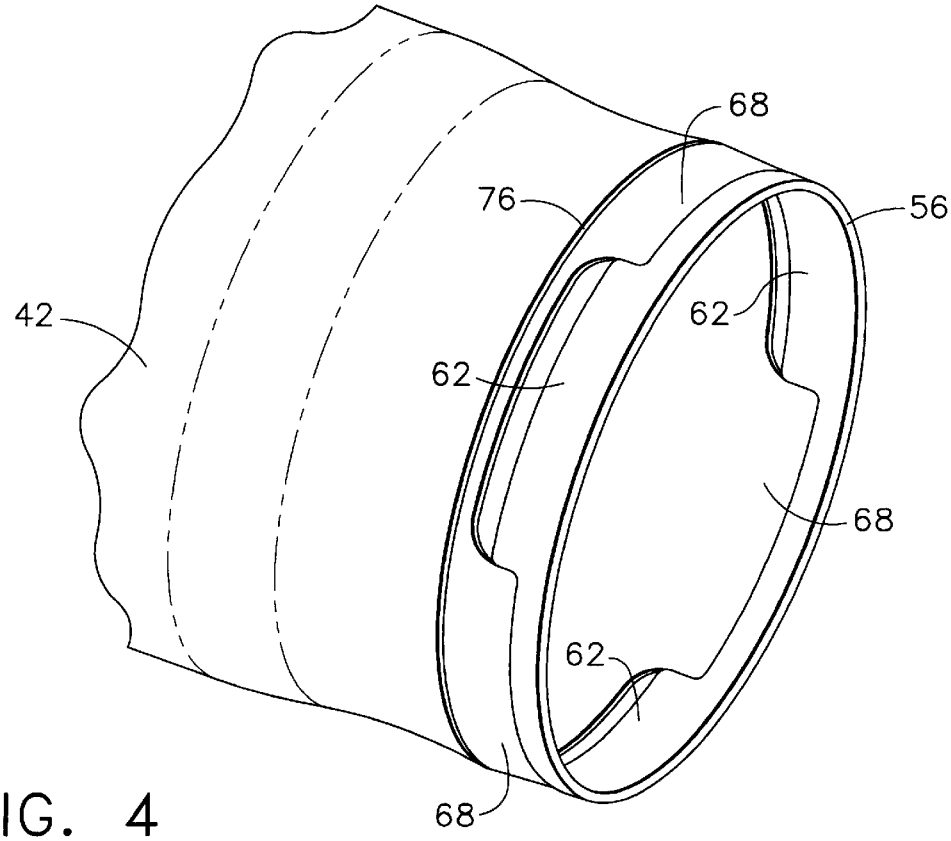
FIG. 4 is an isometric view of the air duct and retaining ring from the air duct coupling of FIG. 3.
Figure 5:
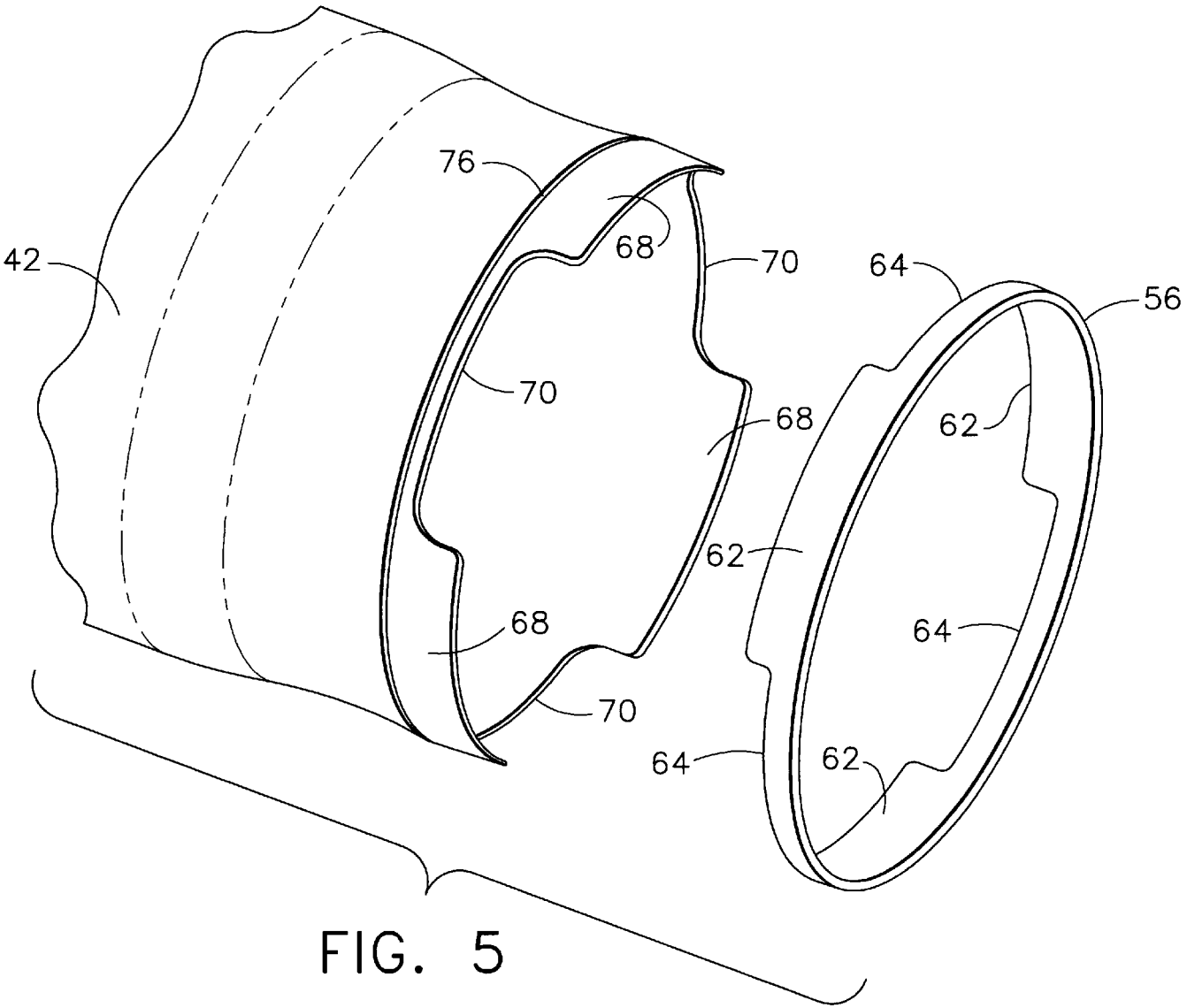
FIG. 5 is an exploded isometric view of the air duct and retaining ring of FIG. 4.

The engine 10 includes a threadless coupling assembly 54 for connecting the aft end of the air duct 42 to the compressor rear shaft 32. As shown in FIGS. 3–5, the primary elements of the coupling assembly 54 are the compressor rear shaft 32, the air duct 42 and a retaining ring 56. The retaining ring 56 and the aft end of the air duct 42 are both disposed in the bore 46 of the compressor rear shaft 32, and they engage one another in the manner described below such that the air duct 42 is securely supported by the compressor rear shaft 32.

The compressor rear shaft 32 has a recess 58 formed in the inner surface of the bore 46 to receive the retaining ring 56 and the air duct 42. The recess 58 extends from the forward end of the bore 46 to a forward-facing, annular retaining lip 60 located a distance aft in the bore 46. The retaining ring 56, which is sized to have no clearance with the inner cylindrical surface of the recess 58 adjacent to the retaining lip 60, is press-fit into the recess 58. The aft edge of the retaining ring 56 abuts the retaining lip 60, which prevents axial movement in the aft direction, and the retaining ring 56 is prevented from rotation relative to the compressor rear shaft 32 by its press-fit in the bore 46. The use of a press-fit for the retaining ring 56 is feasible because the ring 56 is located far enough aft in the bore 46 (and sufficiently remote from the conical portion 40) that the effect of the differential thermal expansion of the compressor rear shaft 32 is diminished.

A set of three tabs 62 extends axially outward from the forward edge of the retaining ring 56. As best seen in FIGS. 4 and 5, the tabs 62 are each approximately 60 degrees in width and are spaced equally around the circumference of the ring 56. Accordingly, three notches 64, which are also approximately 60 degrees in width, are defined between the tabs 62.

The air duct 42 is arranged with its aft end disposed in the bore 46. The air duct 42 and the compressor rear shaft 32 define outer and inner cylindrical surfaces, respectively, that axially overlap with a slight radial clearance. The inner cylindrical surface of the air duct 42 is provided with a coating 66 that acts as a bumper bearing with the second rotor shaft 28. In addition, the outer cylindrical surface of the air duct 42 is provided with a wear coating and a dry lubricant coating. The bore 46 also has a dry lubricant coating applied thereto. The air duct 42 has a set of three tabs 68 extending axially outward from its aft end. Like the retaining ring tabs 62, the air duct tabs 68 are each approximately 60 degrees in width and are spaced equally around the circumference of the air duct 42 so as to define three notches 70 of 60 degree width therebetween. Although both sets of tabs 62 and 68 are shown as comprising three such tabs, it should be understood the sets could comprise a different number of tabs.

The air duct tabs 68 serve two purposes: They support the aft end of the air duct 42 within the bore 46, and they prevent rotation of the air duct 42 with respect to the compressor rear shaft 32. The air duct tabs 68 support the air duct 42 due to radial distortion that occurs when the air duct 42 is rotating with the compressor rear shaft 32. Specifically, because the tabs 68 are discrete and not continuous, the centrifugal force acting on them during rotation is supported by the cylindrical main body portion of the air duct 42, causing it to distort into a somewhat triangular shape. This distortion closes the clearance between the air duct 42 and the compressor rear shaft 32, providing support and centering of the air duct 42.

Relative rotation is prevented by positioning the air duct 42 circumferentially relative to the retaining ring 56 so that the air duct tabs 68 intermesh with the retaining ring tabs 62, as best seen in FIG. 4. That is, the air duct tabs 68 fit snugly into the ring notches 64, and the ring tabs 62 fit snugly into the air duct notches 70. Since the retaining ring 56 is rotatively fixed with respect to the compressor rear shaft 32 by virtue of its press-fit in the bore 46, the intermeshing tabs 62 and 68 prevent any relative rotation between the air duct 42 and the compressor rear shaft 32.

As seen in FIG. 3, the air duct tabs 68 are axially longer than the ring tabs 62. Thus, the ends of the air duct tabs 68 contact the bottom of the ring notches 64. This contact provides the necessary axial loading to prevent substantial axial movement of the air duct 42. The air duct 42 cannot move aft because the retaining ring 56 is fixed axially by the retaining lip 60. The air duct 42 cannot move far enough forward to become extracted from the bore 46 (or for the two sets of tabs 62 and 68 to become disengaged) because its forward end is conventionally connected to the compressor forward shaft 30. The ring tabs 62 do not contact the bottom of the air duct notches 70 by virtue of their shorter length. The resulting gap 72 between the forward edge of each ring tab 62 and the bottom of each air duct notch 70 allows for a larger fillet radius on the air duct tabs 68. It should be noted that this arrangement could be reversed so that the ring tabs 62 contact the bottoms of the air duct notches 70 and a gap is formed between the aft edge of each air duct tab 68 and the bottom of each ring notch 64. This way, the ring tabs 62 could have the large-radius fillets. However, it is preferred that the air duct tabs 68 have the large-radius fillets because the air duct 42 carries more stress than the retaining ring 56.

An external recess 74 is formed in the outer cylindrical surface of the air duct 42, slightly forward of the tabs 68. The recess 74 extends around the circumference of the air duct 42 and receives a seal wire 76. The seal wire 76 contacts the recess 58 of the bore 46 and thereby prevents any undesired air leakage between the air duct 42 and the compressor rear shaft 32.

The coupling assembly 54 of the present invention centers and supports the air duct 42 in the compressor rear shaft 32. While providing radial support of the air duct 42, the coupling assembly 54 does not rigidly fix the aft end of the air duct 42 in bending or vibratory modes, thereby reducing bending or vibratory stresses in the air duct 42. These stresses are further reduced because the coupling assembly 54 has no features forward of the air duct-retaining ring interface that would localize and concentrate stresses. Furthermore, the coupling assembly 54 requires less radial space than conventional connections, which provides a smooth transition from the wall of the air duct 42 to the bore 46 and permits the air duct-retaining ring interface to be located further aft on the compressor rear shaft 32, thereby lessening the affect of differential thermal growth.

The foregoing has described a threadless air duct coupling. While specific embodiments of the present invention have been described, it will be apparent to those skilled in the art that various modifications thereto can be made without departing from the spirit and scope of the invention as defined in the appended claims.

What is claimed is:

1. A coupling assembly comprising:

a shaft member defining a bore;

a retaining ring disposed in said bore, said retaining ring having a first set of tabs; and a duct having a second set of tabs, said duct being disposed relative to said retaining ring so that each tab of said first set of tabs intermeshes with said second set of tabs.

2. The coupling assembly of claim 1 wherein said retaining ring is rotatively fixed with respect to said shaft member.

3. The coupling assembly of claim 2 wherein said retaining ring is press-it in said bore.

4. The coupling assembly of claim 1 wherein said first set of tabs includes three tabs, and said second set of tabs includes three tabs.

5. The coupling assembly of claim 1 wherein each tab of said second set of tabs has an end which contacts said retaining ring.

6. The coupling assembly of claim 5 wherein said tabs of said second set of tabs are provided with large fillets.

7. The coupling assembly of claim 1 wherein said bore has a recess formed therein for receiving said retaining ring and said duct.

8. The coupling assembly of claim 7 wherein said recess defines a retaining lip, and said retaining ring abuts said retaining lip.

9. The coupling assembly of claim 1 further comprising a seal wire disposed between said shaft member and said duct.

10. The coupling assembly of claim 1 wherein said tabs of said first set of tabs extend axially from one edge of said retaining ring.

11. The coupling assembly of claim 1 wherein said tabs of said second set of tabs extend axially from one end of said duct.

12. The coupling assembly of claim 1 wherein said second set of tabs cause said duct to distort radially under a centrifugal load, thereby supporting said duct in said bore.

13. In a gas turbine engine having a compressor forward shaft, a coupling assembly comprising:

a compressor rear shaft defining a bore;

a retaining ring disposed in said bore and rotatively fixed with respect to said compressor rear shaft, said retaining ring having a first set of tabs extending axially from one edge thereof; and a tubular air duct extending between said compressor forward shaft and said compressor rear shaft and having a first end disposed in said bore, said air duct having a second set of tabs extending axially from said first end thereof, said air duct being disposed relative to said retaining ring so that each tab of said first set of tabs intermeshes with said second set of tabs.

14. The coupling assembly of claim 13 wherein said retaining ring is press-fit in said bore.

15. The coupling assembly of claim 13 wherein said first set of tabs includes three tabs, and said second set of tabs includes three tabs.

16. The coupling assembly of claim 13 wherein each tab of said second set of tabs has an end which contacts said retaining ring.

17. The coupling assembly of claim 16 wherein said tabs of said second set of tabs are provided with large fillets.

18. The coupling assembly of claim 13 wherein said bore has a recess formed therein for receiving said retaining ring and said air duct.

19. The coupling assembly of claim 18 wherein said recess defines a retaining lip, and said retaining ring abuts said retaining lip.

20. The coupling assembly of claim 13 further comprising a seal wire disposed between said compressor rear shaft and said air duct.

21. The coupling assembly of claim 13 wherein said second set of tabs cause said air duct to distort radially under a centrifugal load, thereby supporting said air duct in said bore.

22. A method for connecting an air duct to a compressor rear shaft having a bore in a gas turbine engine, said method comprising the steps of:

inserting a retaining ring having a first set of tabs into said bore;

providing a first end of said air duct with a second set of tabs; and inserting said first end of said air duct into said bore and positioning said air duct relative to said retaining ring such that each tab of said first set of tabs intermeshes with said second set of tabs.

23. The method of claim 22 wherein said step of inserting said retaining ring into said bore includes rotatively fixing said retaining ring with respect to said compressor rear shaft.

24. The coupling assembly of claim 1 wherein said tabs of said first set of tabs extend axially from one edge of said retaining ring and are equally spaced circumferentially around said retaining ring to define a first set of notches therebetween, said first tabs and said first notches having equal widths, and wherein said tabs of said second set of tabs extend axially from one end of said duct and are equally spaced circumferentially around said duct to define a second set of notches therebetween, said second tabs and second notches having equal widths.

25. The coupling assembly of claim 13 wherein said tabs of said first set of tabs are equally spaced circumferentially around said retaining ring to define a first set of notches therebetween, said first tabs and said first notches having equal widths, and wherein said tabs of said second set of tabs are equally spaced circumferentially around said duct to define a second set of notches therebetween, said second tabs and second notches having equal widths.

* * * * *